US011330899B2

(12) United States Patent
Premananda

(10) Patent No.: US 11,330,899 B2
(45) Date of Patent: May 17, 2022

(54) HIGH CAPACITY BRUSH CLEANER

(71) Applicant: Ganeshananda Roshan Premananda, Brick, NJ (US)

(72) Inventor: Ganeshananda Roshan Premananda, Brick, NJ (US)

( * ) Notice: Subject to any disclaimer, the term of this patent is extended or adjusted under 35 U.S.C. 154(b) by 492 days.

(21) Appl. No.: 16/607,022

(22) PCT Filed: Feb. 21, 2018

(86) PCT No.: PCT/US2018/018939
§ 371 (c)(1),
(2) Date: Oct. 21, 2019

(87) PCT Pub. No.: WO2018/156571
PCT Pub. Date: Aug. 30, 2018

(65) Prior Publication Data

US 2020/0128948 A1 Apr. 30, 2020

Related U.S. Application Data

(60) Provisional application No. 62/461,771, filed on Feb. 21, 2017.

(51) Int. Cl.

| | |
|---|---|
| ***A46B 17/06*** | (2006.01) |
| ***B08B 1/00*** | (2006.01) |
| ***B08B 3/08*** | (2006.01) |
| ***B08B 3/10*** | (2006.01) |
| ***B08B 7/02*** | (2006.01) |

(52) U.S. Cl.
CPC ..... *A46B 17/06* (2013.01); *B08B 1/008* (2013.01); *B08B 3/08* (2013.01); *B08B 3/102* (2013.01); *B08B 7/02* (2013.01); *A46B 2200/1046* (2013.01)

(58) Field of Classification Search
CPC ..... A46B 17/06
See application file for complete search history.

(56) References Cited

U.S. PATENT DOCUMENTS

2009/0189084 A1* 7/2009 Pinsky ..... A46B 17/06 206/362.2

* cited by examiner

*Primary Examiner* — Jason Y Ko
(74) *Attorney, Agent, or Firm* — Mainline Intellectual Property; Syam Anand

(57) ABSTRACT

Methods and apparatus for cleaning large numbers of brushes quickly, comfortably and efficiently are disclosed. The apparatus contains a cleaning chamber comprising cleaning elements disposed on a cleaning plate within the chamber that contacts the brushes during cleaning, the cleaning chamber in contact with a drive and a motor that can deliver repetitive motions to the cleaning elements. Further it comprises a lid configured to hold brushes in securement members on the lid, one or more vibratory motors that provides vibratory motions to the cleaning chamber, and a solvent circulation system that is configured to deliver and drain solvents between the reservoir and cleaning chambers and also filter and recirculate them during the cleaning cycles, and drain out used solvents from the cleaner after a cleaning operation. The apparatus also contains means to hasten drying of washed brushes. Some embodiments allow easy transport of the large capacity cleaner.

19 Claims, 5 Drawing Sheets

HIGH CAPACITY BRUSH CLEANER

PRIORITY INFORMATION

This application claims priority to the PCT application PCT/US18/18939 filed on Feb. 21, 2018, that claims priority to the U.S. provisional application 62/461,771 filed on Feb. 21, 2017 entitled "High Capacity Brush Cleaner" and are incorporated herein in their entirety by reference.

BACKGROUND

Makeup artists, dancers, performers, musicians, stage-show artists, cosmetic shops, beauty shops, spas and such use dozens of cosmetic brushes to apply makeup and various cosmetic products to body parts. Most makeup and cosmetic products are sticky and hard to remove from the brushes. Accumulated residue on the brushes affects their use. Prompt cleaning is required for complete removal of these residues immediately after use because the longer they stay on the brushes the more difficult it is to remove them, as they dry up and become hard. If the brushes are to be shared, cleaning between uses is also required to maintain personal hygiene, especially in environments such as professional makeup artists, dancers, performers, musicians, stage-show artists and such. A common solution to clean the makeup brushes is to clean them manually under running water, which is time consuming and inefficient, especially when the number of brushes that need to be cleaned are in the range of a few dozens.

Mechanical brush cleaners are used to clear away dirt and debris from artist paint brushes, building paint brushes, hair brushes, makeup brushes, scrub brushes, wheel brushes and the like. Mechanical scrubbing of brushes increases the efficiency of dirt and debris removal. Mechanical scrubbing can be done with or without the aid of water or other solvents. Therefore, it is common to find the use of power-operated machines or brush cleaners for mechanical scrubbing and cleaning of various types of brushes either alone or in combination with water or other solvents. Currently there are no efficient mechanical brush cleaners to clean such large numbers of brushes such as a few dozens. Make up artists and professionals require large capacity brush cleaners on an almost daily basis. Brush cleaners designed for personal use are just that in that they can hold and clean only around half a dozen or less number of brushes at a time. The large amount of solvents needed to clean dozens of brushes at a time and the large amount of dirt and debris that comes off during the cleaning of dozens of brushes are unmet challenges. In fact currently there are no large capacity brush cleaners that can clean about 10 to about a hundred brushes at once. The variety of brushes that needs cleaning is also an unmet need. For example, there are no brush cleaners that can accommodate the largest cosmetic brushes used in the industry without immediately and permanently distorting the brush securement elements on the brush cleaners. Cleaning time is also an unmet challenge as current brush cleaners fail to clean large numbers of brushes within 10-30 minutes. Another unmet challenge is travel. Professional makeup artists, dancers, performers, musicians, stage-show artists travel a lot and currently there are no brush cleaners that meet their demands for high capacity exceeding two dozen brushes and at the same time is portable.

Since a wide variety and number of brushes need to be handled at the same time in commercial environments, the optimal use of space is also important to not just hold brushes and solvents, but the cleaner itself. It is also important for storage and transport of brush cleaners to different locations, if needed, especially since many of its potential end-users as mentioned above, could be travelling extensively frequenting many locations. Thus, there is a great need in the makeup and entertainment industry for more efficient and timesaving brush cleaners that can clean brushes at a large scale.

SUMMARY

Disclosed herein are methods and apparatus for large scale cleaning of brushes. In some embodiments, a brush cleaner comprises a base and at least one motor mounted on the base and connected to a drive, wherein the drive is configured to provide repetitive and/or reciprocating motions to a cleaning chamber. It also comprises one or more vibratory motors that produces vibratory motions on the chamber. The cleaning chamber is in contact with the drive, and a plurality of cleaning elements is disposed within the cleaning chamber. The brush cleaner also comprises a lid configured to hold a half a dozen or more brushes in securement members on the lid such that the lid positions bristles of the brushes on the cleaning elements of the brush cleaner at beginning of a cleaning cycle and away from the elements after the end of a cleaning cycle. Further, the brush cleaner also comprises a solvent circulation system that is configured to deliver solvents from a reservoir into the cleaning chamber and remove them as well as to drain used solvents from the reservoir and the c leaning chamber. The brush cleaner also comprises a filtration system that continuously removes dirt and debris coming off from the brushes into the solvent as it gets drained into the reservoir.

In some embodiments, the solvent circulation system is configured to constantly or continuously recycle solvents between the chamber and the reservoir to increase the efficiency of cleaning while reducing the amount of solvent required to clean the brushes.

In some embodiments, the brush cleaner comprises a base and a cleaning chamber comprising a plurality of cleaning elements disposed on a cleaning plate, the cleaning plate comprising a flat detachable element that snugly fits into the cleaning chamber. The cleaning chamber also comprises one or more flat- or paddle-shaped elements configured to increase mixing of the solvents within the chamber. Further, a vibratory motor attached to the base of the cleaning chamber is configured to vibrate the cleaning plate or the cleaning chamber or both. Also, a lid attached to the cleaning chamber, wherein the lid comprises a plurality of securement members configured to hold brushes. The embodiments also comprise a solvent circulation system comprising a reservoir and one or more compartments that is fluidically in contact with the cleaning chamber and is configured to deliver solvents from the compartments into the cleaning chamber, and drain solvents from the cleaning chamber into the compartments, and a filtering system comprising filters or filter cartridges within the solvent circulating system configured to remove dirt and debris present in the solvents drained into the compartments. In some embodiments, a motor is mounted on the base and attached to the undersurface of the cleaning chamber via a drive, and the motor and the drive are configured to provide repetitive motions to the cleaning chamber. A user interface for programming operations of the brush cleaner is also provided.

In some embodiments, the cleaning chamber, lid and solvent system can be programmed for constant or variable speed, step-size, direction, nature and duration producing different cleaning cycles.

In some embodiments, the cleaning elements are provided on a detachable cleaning plate that stably fits into the shape and configuration of the cleaning chamber.

In some embodiments, the cleaning elements, cleaning chamber and reservoir are dishwasher safe.

In some embodiments, the opening of the lid is programmed to mark the end of a cleaning cycle wherein the lid is configured to automatically hold brushes in a position that drains solvents sticking to the brushes into the cleaning chamber at the end of a cleaning cycle and subsequently air drying the brushes that remain attached to the open lid.

In some embodiments, the solvent system is programmed to deliver solvents into the chamber before a cleaning cycle begins and recycle them during a cleaning cycle and to drain solvents from the chamber at the end of a cleaning cycle.

In some embodiments, the solvent system is programmed to sun soak, wash and rinse segments during a cleaning cycle.

In some embodiments, the motions of the cleaning chamber, movement of the solvents through the solvent system and opening and closing of the lid are programmable to run custom cleaning cycles.

In some embodiments, the brushes are secured to the lid through securement members present on the lid, using elastic bands with more than one fused criss-cross, made of a thermoplastic elastomer material, and capable of stretching 1.5 to 5 times.

In some embodiments, the cleaning chamber is configured to undergo circular or back and forth reciprocating motions of about 10-1000 times per minute.

In some embodiments, the cleaning chamber is configured to undergo up and down repetitive motions of about 10-1000 times per minute, the up and down motions pressing the brushes repeatedly against the cleaning elements and the cleaning plate.

In some embodiments, the cleaning chamber is configured to undergo both back and forth and up and down repetitive motions.

In some embodiments, the brush cleaner further includes a housing encasing the motor, drive, and pumps that deliver, recycle or drain solvents from the reservoirs and chambers.

In some embodiments, the reservoir is partitioned into two chambers, each chamber serving to hold different solvents for cleaning.

In some embodiments, the brush cleaner comprises leveling mechanisms such as spirit levels and leveling screws.

In some embodiments, the brush cleaner comprises a placement plate that guides the right placement of brushes within the securement members present on the lid before beginning the cleaning process.

In some embodiments, the brush cleaner is securely integrated into a container on wheels that can be carried around as a piece of luggage. Further, it allows access to the brush cleaner by opening the luggage.

In an embodiment, a kit includes a brush cleaner that can be separated into parts for easy transporting and reassembled back for use when required and a transportation-cum-storage box on wheels. The kit may also have instructions for taking the parts apart and putting them together at convenience.

In an additional embodiment, the kit further comprises a plurality of disposable cleaning elements, a plurality of cleaning plates and other replaceable parts and instructions to replace them.

In an additional embodiment, the kit also includes one or more solvents for cleaning brushes.

DETAILED DESCRIPTION

Figure 1:
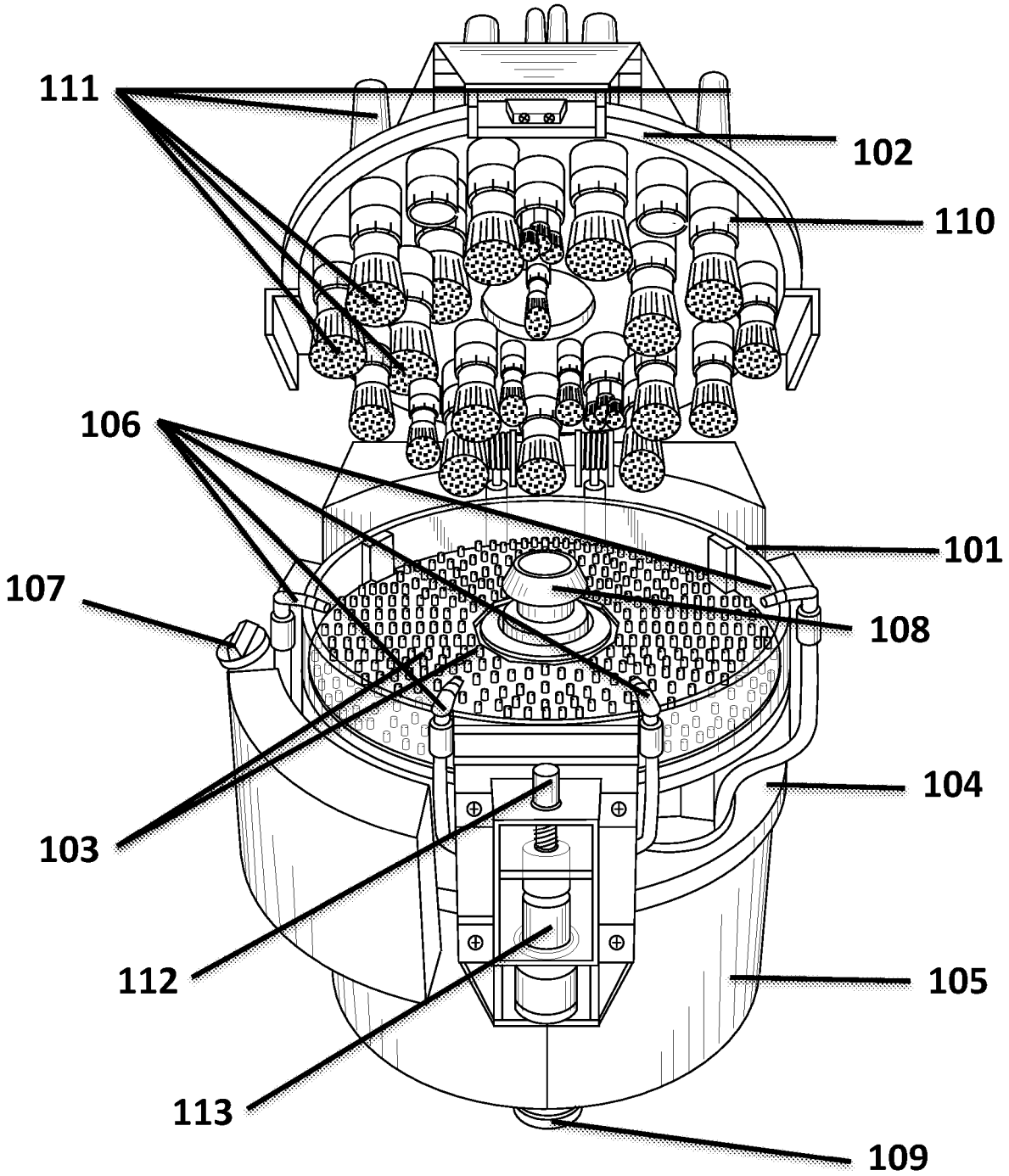
FIG. 1 depicts a front view of a brush cleaner with its lid open according to an embodiment and holding several cosmetic brushes.
Figure 2:
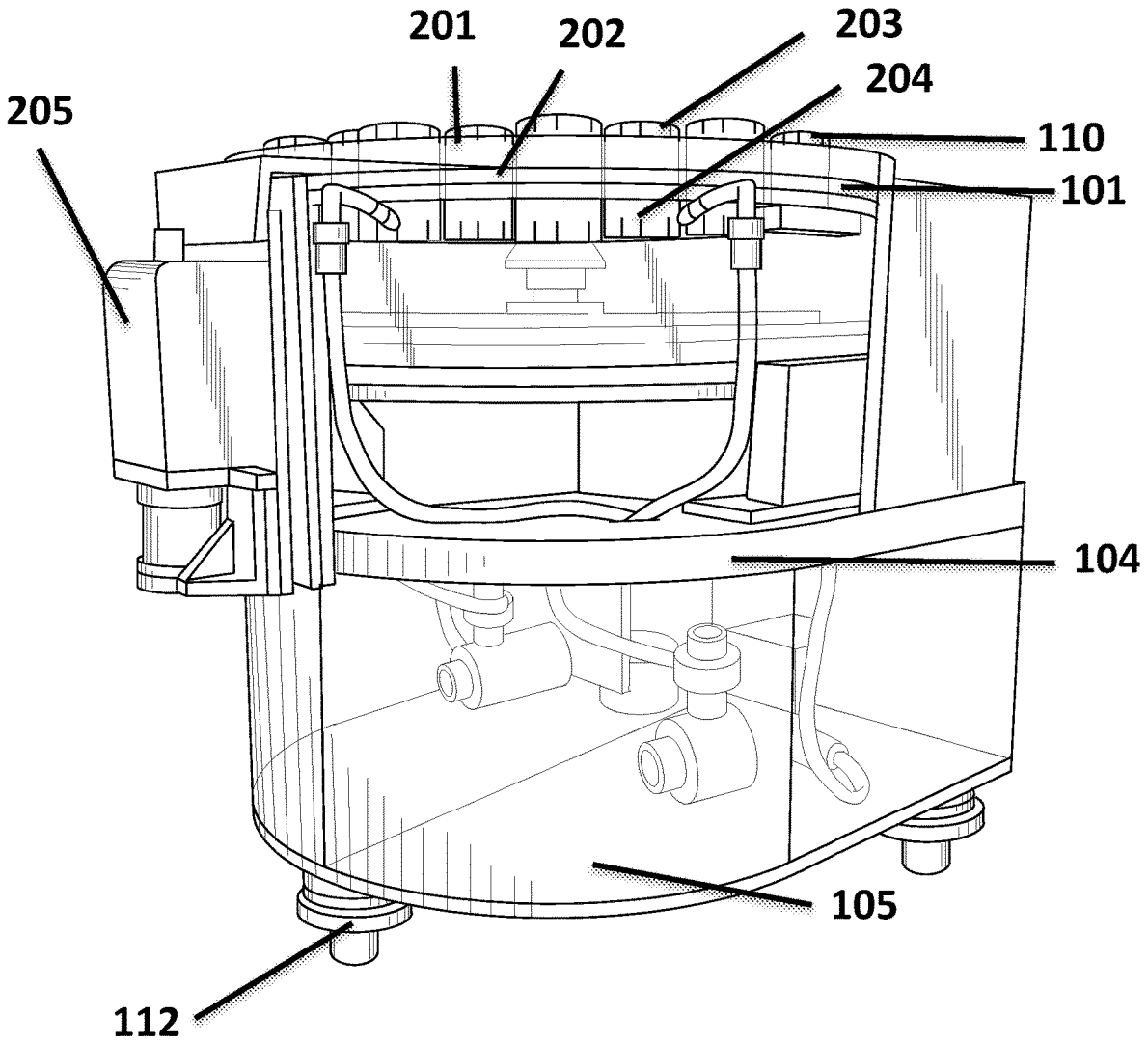
FIG. 2 depicts a front view of a brush cleaner with its lid closed according to an embodiment.

FIG. 1 depicts an exemplary embodiment of a brush cleaner with a cleaning chamber 101, and a lid 102 that functions as the brush holder. In the figure, the lid of the cleaner is open. The cleaning chamber 101 comprising a plurality of cleaning elements 103 disposed within the chamber 101 is connected to a drive and a motor encased within a housing 104 of the brush cleaner. A reservoir 105 is present beneath the base or housing 104. A solvent flow system circulates water or cleaning solutions from the reservoir to the cleaning chamber through one or more dispensing ports 106 that are present adjacent to the cleaning chamber. An operating switch 107 on a control panel on the main body of the brush cleaner regulates power to all the motors in the brush cleaner. The control panel also has additional buttons or switches for additional functions and they function together as a user interface to program the brush cleaner for desired cleaning cycles that may depend on the number and type of brushes to be cleaned. There are also buttons that can drain the entire contents of one of the reservoir chambers and cleaning chamber at the push of a button. A spirit level 108 helps to level the cleaner against the surface on which it rests using leveling screws 109. Multiple brush securement members 110 on the lid hold brushes 111 in place for cleaning and drying. The brush cleaner also has a separate switch 112 for the lid that can be used to manually stop the brush cleaner and open the lid at once. The brush cleaner lid opening may be also controlled through an electromagnetic lock release 113 that can be programmed from the control panel. The control panel also allows programming of all other functions/motions of the brush cleaner. FIG. 2 depicts a brush cleaner with the lid is closed.

As shown in FIG. 2, the lid of an embodiment has an upper surface 201 and a lower surface 202. Several brush securement members 110 are integrated into the lid at multiple locations (FIG. 1 and FIG. 2). The brush securement members have a proximal end 204 oriented towards the cleaning chamber 101, and a distal end 203 oriented away from the cleaning chamber. The brushes are placed in the securement members with their bristles towards the proximal end 204 of the securement members, and their handles towards the distal ends 203 of the securement members. Each securement member can hold or secure one or more brushes. When the brush holder carrying one or more brushes is closed, the lid 102 along with the securement members 110 position the brushes 111 such that the brushes' bristles come in contact with the cleaning elements 103 within the cleaning chamber 101. In the open position of the lid, as shown in FIG. 1, the bristles of the brushes do not contact the cleaning elements.

Figure 3:
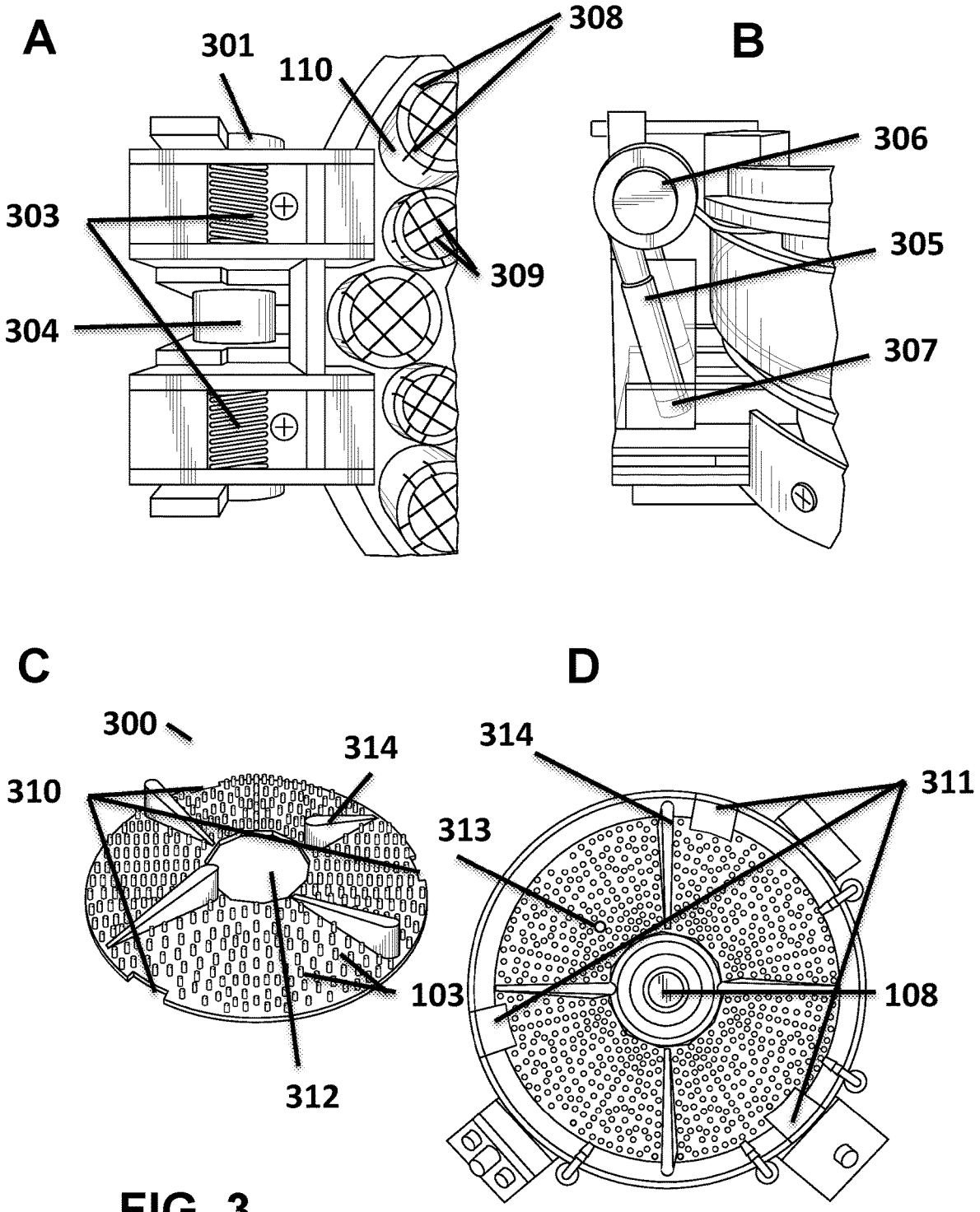
FIGS. 3A and 3B depict views of a lid opening-closing elements of a brush cleaner according to an embodiment.
FIGS. 3C and 3D depict cleaning plate and cleaning chamber of a brush cleaner according to an embodiment.

As shown in FIG. 3A, the lid of an embodiment is secured to the housing of the cleaner through a hinge 301 around which the lid can swivel into an open position (as shown in FIG. 1) or a closed position (as shown in FIG. 2). A lock 205 further secures the lid, and preferably present diametrically opposite to the hinge, to its complementary part on the housing (FIG. 2). The lock can exist in locked or unlocked states. The lid may be locked manually by pressing the lid against the housing 104 and the cleaning chamber 101. The lid may be unlocked by releasing the clasping lock 205 that holds it in place. Other types of locking mechanisms known in the art may also be used to perform the same function. The release may be controlled either electronically through the electromagnetic lock release 113 by programming the cleaner or manually by operating or pressing the lid switch 112.

One or more springs 303, preferably of the torsion type, in the hinge, aid opening of the lid (FIG. 3A). The springs are configured to load when the lid is closed manually. The load is released when the lock is unlocked. The load is used to swing open the lid through a fulcrum 304, upon the release of the lock 205 either manually through 112 or through the lock release 113. This may help to open the lid as loading of dozens of brushes on the lid require large forces to open the lid against gravity and keep the bristles of the brushes away from the solvents and the chamber for subsequent drying and/or removal.

The lid opening-closing mechanism also employs one or more dampers 305 (FIG. 3B), preferably of the hydraulic dashpot type. Other types of dampers known in the art may be used. The dampers are configured such that the dampers' load works against the load of the springs to smoothen the opening and closing of the lids. This prevents splashing and spilling of solvents that may result from abrupt opening of the lid. Moreover a large amount of solvent sticks to the brushes when the cleaning cycles are completed and it is important to ensure that this water drips or drains into the chamber instead of spilling outside the cleaner. The upper end of damper 306 is secured to the hinge and the lower end of the damper 307 is secured to the base or housing. The lid opening-closing mechanism is designed to support the loading, cleaning, unloading and drying of dozens of brushes at a time without spilling solvents outside the cleaner.

As shown in FIG. 3A, brush securement member 110 has grooves 308 into which elastic bands 309 are inserted. A top view of the brush securement member 110 carrying the elastic bands 309 is shown in FIG. 3A. In the example in FIG. 3A, each securement member shows four sets of grooves that accommodate two elastic bands. This configuration of the brush securement member holds most of the commonly used cosmetic brushes, including the largest brushes, securely for cleaning, without permanently distorting the shape of brush holders or securement members. In some embodiments, one or more brush securement members may hold one or more brushes that are about 0.2 to 1 cm in thickness, about 1 cm to 2 cm in thickness, or about 2 cm to 6 cm in thickness. Brushes can be inserted into these elastic bands to hold them securely during cleaning and drying. The number of grooves 308 and elastic bands 309 in the brush securement members 110 can be increased or spaced appropriately to accommodate any brush. Further, elastic bands 309 can be easily replaced by slipping them out of the grooves and replacing them with new ones. In addition, a supply of disposable elastic bands 309 can be contemplated for replacement as and when needed. This lessens the worry of worn out, distorted or broken brush holders for the brush cleaner users.

In one embodiment, an elastic band used to secure brushes on the securement members is one with more than one fused criss-cross made of a thermoplastic elastomer material and capable of stretching 1.5 to 5 times. Such elastic bands may find applications in addition to their use in commercial brush cleaners. In the embodiment shown in FIGS. 1 and 3, the elastic bands are rubber bands.

As shown in FIGS. 1 and 2, a brush cleaner may have a lid that is circular. In some embodiments, the lid may be of any shape such as square, triangular, conical, pyramidal, pentagonal, hexagonal and the like. In some embodiments, the lid has a diameter from 6 inches to 36 inches and thickness from 0.1 to 50 millimeters. The exemplary lid 101 shown in FIG. 1 is cylindrical, 29 cm in diameter and 0.5 cm thick. The lid may be made from polymers, such as polyoxymethylene, acrylonitrile butadiene styrene (ABS), polyurethane, a polyester, an epoxy resin, a phenolic resin, polyethylene (PE), polypropylene (PP), polyvinyl chloride, polystyrene, or any combination thereof. Alternatively, the lid may be made from metals such as aluminum, silver, gold, copper, zinc, iron, silicon, and the like, or from metal alloys. In addition, lids made largely with one material may be coated with another material or combination of materials by any of the means known in the art to give a different appearance. In some embodiments, the inner surface of the lid may be coated with a hydrophobic or hydrophilic coating. Further, such coatings may be carried out to enhance desirable surface properties of the lid, for example to reduce stickiness of the surface for dirt and debris, or for aesthetic purposes. The exemplary lid 102 shown in FIG. 1 is made from plexiglass.

In some embodiments, the lid may have overhangs, projections, grooves or other modifications on the edges to guide it into position on the cleaning chamber when it is closed. In some embodiments the lid opening mechanism may be configured to stop in pre-set positions, each position holding the lid at a different angle with respect to the cleaning chamber such as 20 degrees, 45 degrees (half-open), 75 degrees and 90 degrees (fully open) etc.

In some embodiments a small fan may be provided on the base or housing that faces the bristles on the open lid of the cleaner to increase the speed of drying of the brushes after they are cleaned.

In some embodiments, a rubber gasket or the like that fits around the bottom perimeter of the lid could be used to seal the space between the lid 102 and the cleaning chamber 101 to prevent solvent spills, splashes and leaks during cleaning cycles. The gasket could also seat the lid 102 properly on the cleaning chamber 101. Alternatively, a gasket or the like can be fitted around the top perimeter of the cleaning chamber 101 to carry out the same function. Additionally, bushes or springs may be placed around the lid or the cleaning chamber to smoothen the closing and locking of the lid to the cleaning chamber.

As shown in FIG. 3A, a brush cleaner may have securement members 110 that are circular. In some embodiments, the securement members may be of any shape such as square, triangular, conical, pyramidal, pentagonal, hexagonal and the like. In some embodiments, the securement member has a diameter from 0.3 cm to 12 cm and length from 2 cm to 18 cm. The exemplary securement member 110 shown in FIG. 1 is cylindrical, 3 cm in diameter and 0.2 cm thick, 4 cm long and made of PVC. The securement members may be also made from polymers, such as polyoxymethylene, acrylonitrile butadiene styrene (ABS), polyurethane, a polyester, an epoxy resin, a phenolic resin, polyethylene (PE), polypropylene (PP), polyvinyl chloride, polystyrene, or any combination thereof. Alternatively, the securement members may be made from metals such as aluminum, silver, gold, copper, zinc, iron, silicon, and the like, or from metal alloys. In addition, securement members made largely with one material may be coated with another material or combination of materials by any of the means known in the art to give a different appearance. Further, such coatings may be carried out to enhance desirable surface properties of the lid, for example to reduce stickiness of the surface for dirt and debris, or for aesthetic purposes.

As shown in FIG. 1, a cleaning chamber 101 may be cylindrical. In some embodiments, the cleaning chambers may have can be of any shape such as cylindrical, square, triangular, conical, pyramidal, pentagonal, hexagonal and the like. In some embodiments, the cleaning chamber has a height from 3 inches to 16 inches, and diameter from 6 inches to 36 inches. The thickness of the walls of the cleaning chamber may be from 0.1 to 50 millimeters. The exemplary cleaning chamber 101 shown in FIG. 1 is cylindrical, 29 cm in diameter, 5 cm tall, and has a wall that is 5 mm thick. The cleaning chamber may be made from polymers, such as polyoxymethylene, acrylonitrile butadiene styrene (ABS), polyurethane, a polyester, an epoxy resin, a phenolic resin, polyethylene (PE), polypropylene (PP), polyvinyl chloride, polystyrene, or any combination thereof. Alternatively, the cleaning chambers may be made from metals such as aluminum, silver, gold, copper, zinc, iron, silicon, and the like, or from metal alloys. In addition, cleaning chambers made largely with one material may be coated with another material or combination of materials by any of the means known in the art to give a different appearance. In some embodiments, the inner surface of the cleaning chamber may be coated with a hydrophobic or hydrophilic coating. Further, such coatings may be carried out to enhance desirable surface properties of the cleaning chamber, for example to reduce stickiness of the surface for dirt and debris, or for aesthetic purposes. The cleaning chamber 101 may be also made from any of the plastics known in the art that is appropriate for high-load mechanical applications. The exemplary cleaning chamber 101 shown in FIG. 1 is made from plexiglass.

As shown in FIG. 1 and according to an embodiment, the cleaning chamber 101 includes a plurality of cleaning elements 103 disposed on the inner bottom of the cleaning chamber and are configured to clean the bristles of the brushes during operation. The cleaning elements 103 can be solid, hollow, rigid or flexible rods ranging in size from 0.1 mm to 10 mm in diameter and 1 mm to 300 mm in length. The cleaning elements could be arranged individually, separated from each other by a distance between 0.1 mm to 30 mm. Alternatively, the cleaning elements could be arranged in groups with the groups themselves being separated from each other by a distance between 0.1 mm and 30 mm. For example, cleaning elements that are smaller in dimensions may be grouped. The cleaning elements may have cross sections that are largely circular, square, triangular, pentagonal, hexagonal and the like. They may be straight, curved or wavy. They may be arranged on any of the inner surfaces of the cleaning chamber such as sides, edges or bottom of the cleaning chamber. The cleaning elements 103 may be short, appearing as stubs within the chamber 101. In some embodiments, the cleaning elements may be arranged in a defined pattern, such as in concentric circles. The cleaning elements may be of uniform length or may be of different lengths.

The cleaning elements 103 may be attached to the inner bottom of the cleaning chambers 101 by adhesives, screws, snug-fit, clamps, pins, nuts, threads, rivets and the like known in the art. The cleaning elements 103 may be made from any of the polymers such as polyoxymethylene, acrylonitrile butadiene styrene (ABS), polyurethane, a polyester, an epoxy resin, a phenolic resin, polyethylene (PE), polypropylene (PP), polyvinyl chloride, polystyrene, or any combination thereof, metals such as aluminum, silver, gold, copper, zinc, iron, silicon, and the like, or metal alloys. Further, the cleaning elements may be coated with another material to increase performance and aesthetics or bring in desirable characteristics such as non-stickiness. In some embodiments, the bottom surface of the cleaning chamber may contain sockets with grooves, and the cleaning element may be threaded into the socket so that they fit into the socket tightly.

In the exemplary embodiment in FIG. 3C, the cleaning elements 103 are shown as rod shaped elements, which are 1 mm in diameter and 10 mm long, and made of Acrylonitrile Butadiene Styrene (ABS). They are arranged in circles. In some embodiments, the cleaning elements may be arranged in linear rows to increase the efficiency of cleaning.

In the exemplary embodiments in FIG. 3C and FIG. 3D, the cleaning elements 103 are not individually attached to the inner bottom of the cleaning chamber 101, but instead they are provided on a cleaning plate 300 that is removably attached to the cleaning chamber. The detachable cleaning plate 300 comprises a flat surface, and a plurality of cleaning elements 103 disposed on the flat surface as projections. The cleaning plate 300 may be made from polymers such as polyoxymethylene, acrylonitrile butadiene styrene (ABS), polyurethane, a polyester, an epoxy resin, a phenolic resin, polyethylene (PE), polypropylene (PP), polyvinyl chloride, polystyrene, or any combination thereof. They may be made from any plastic, metal such as aluminum, silver, gold, copper, zinc, iron, silicon, and the like or metal alloy that is used in the art for high load applications. The underside of the cleaning plate 300 may have means to attach to the inner bottom of the cleaning chamber. Attachment may be made through complementary threads, screws, clamps, pins, nuts, threads, rivets and the like known in the art.

In the embodiment shown in FIGS. 3C and 3D, the attachment of the cleaning plate 300 to the cleaning chamber 101 is made through a snug-fit sliding attachment. Grooves 310 in the cleaning plate 300 slide along the elevated guides 311 present on the inner walls of the cleaning chamber 101 and snug-fit onto it, keeping the cleaning plate 300 in place when the chamber 101 undergoes reciprocating or repetitive, and vibratory motions. A hole 312 at the center of the plate 312 fits through a longitudinal member that supports the spirit level 108 at its distal end, also allows the cleaning plate to remain in place during operation of the brush cleaner. In the embodiments shown in FIGS. 3C and 3D, the cleaning elements 103 are permanently attached to the socket present on the bottom of the cleaning plate 300 with an adhesive.

In some embodiments, the cleaning chamber also comprises one or more flat- or paddle shaped elements 314. They may be arranged along the sides of the chamber as shown in FIG. 3D or they may be interspersed with the cleaning elements on the cleaning plate 300 as shown in FIG. 3C. They function to increase the mixing and circulation of the large volume of solvents in the cleaning chamber. The paddle-shaped elements do no exceed the height of the chamber. These elements may be of the squarish, rhomboid, triangularish, leaf-shaped, oval or tapering or not tapering in shape. In some embodiments, they are placed in a manner that avoids direct contact with the brushes held for cleaning. These elements may be made from one or more or a combination of any of the materials described for making cleaning elements and chamber. The paddles may increase the efficiency of cleaning and reduce the time required for cleaning dirty brushes by several fold.

In some embodiments, a vibratory motor provides vibratory motions to the chamber, which may be in addition to its reciprocating motion driven by another motor. The vibratory motor may comprise a permanent magnet and an electromagnet attached to the base or housing. In some embodiments, an eccentric rotating mass vibration motor (ERM) that uses a small unbalanced mass on a DC motor, when it rotates it creates a force that translates to vibrations. In some embodiments, a linear resonant actuator (LRA) that contains a small internal mass attached to a spring creates a force when driven resulting in vibrations. In some embodiments, the vibratory motor may be attached to the cleaning chamber. The vibrations from the motor are delivered to the cleaning chamber by a drive that contacts the chamber. The vibratory motors may produce 10-1000 oscillations per second depending upon the input to the coils. The coils may be controlled by methods known in the art. For example, this may be done by adding a potentiometer to the circuit. The vibratory motions may be in the range of 0.01-10 mm. In some embodiments, ultrasonic or sonic vibrations may be produced in the cleaning elements to increase the cleaning efficiency. The vibratory motions may increase the efficiency of cleaning and reduce the time required for cleaning dirty brushes by several fold.

A brush securement member 110 may position the bristles of a single large cosmetic brush against the cleaning elements 103 or it may position the bristles of two or more smaller cosmetic brushes against the cleaning elements 103. The elastic bands that secure the brushes to the securement members expand to hold multiple brushes in position as needed. This is an added advantage as the brush holder along with its unique securement members further enhances the flexibility, adaptability, capacity and capability of the brush cleaner to clean larger numbers and more variety of brushes.

In some embodiments, caps are provided that fit into openings at the distal end 203 of unused brush securement members. The caps will keep the openings closed during cleaning cycles and prevent splashing and spilling of solvents outside through unoccupied securement members.

In some embodiments a placement plate that can be fixed to the lid provides a surface parallel to the lid at a fixed distance from it. The plate mimics the distance from the lid to the cleaning elements when the lid is closed tight. Thus, the plate can be used as a guide to precisely position all the brushes such that the bristles before closing the lid so that the bristles do not press too tightly against the cleaning elements and the cleaning plate nor are they held too far from the cleaning elements when the lid is closed for brush cleaning. This feature increases the efficiency of positioning a large number of brushes properly on the securement members and helps to prevent individual readjustment of the brushes after closing the lid, which can be tedious and also result in inefficient cleaning. Instead of being flat, the placement lid may have patterns that help to position brushes more gently or more closely on the cleaning elements based on different cleaning requirements. Further, the placement plate distance may be increased or decreased depending upon individual preferences, cleaning solvents preferred or used and experiences. The placement plate is removed before closing the lid and starting the cleaning cycles. This may increase the efficiency of cleaning and reduce the time required for cleaning dirty brushes by several fold as proper, desired or optimal placement of brushes against the cleaning elements with the help of the placement plate will increase efficiency of cleaning.

Figure 4:
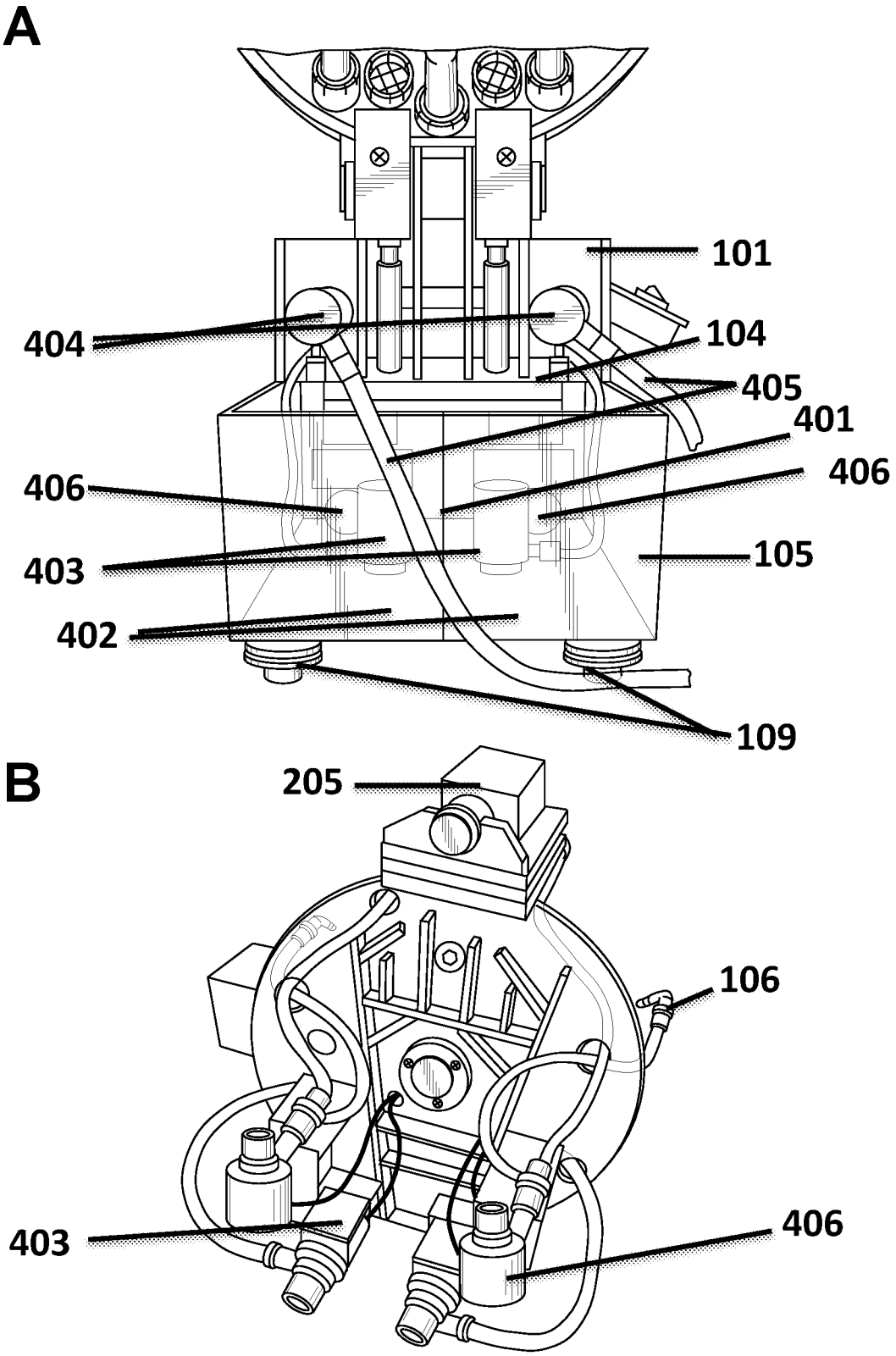
FIGS. 4A and 4B depict some components of the brush cleaner that help to fill, circulate and remove solvents according to an embodiment.

In some embodiments, a reservoir 105 is provided under the housing 104 and can be fluidically connected to the cleaning chamber 101. The reservoir may be filled with cleaning solvents such as water or soap solution. In the embodiment shown in FIGS. 1, 2 and FIG. 4A, the reservoir is split into two chambers 402 by a partition 401. The two chambers 402 may be filled with different solvents. Two pumps 403 are provided in the chambers 402 that help to drain the solvents out of the brush cleaner through outlets 404 connected to tubes 405. The tubes may drain into a large container such as a bucket or directly into a sink. Separate switches may be provided on the control panel of the brush cleaner to operate the two pumps 403 so that the reservoir chambers can be emptied at will at the press of a button. Further, the draining once initiated with the pumps may continue without the pumping action and with the help of gravity flow until the contents of the chambers 402 are empty. The tubes may be permanently attached to the outlets or detachable. Further, the tubes may be flexible or rigid. In the embodiment shown in FIGS. 4A and 4B, the tubes are detachable and flexible. In addition, the embodiment also has separate switches on the control panel for draining either reservoir chamber.

In some embodiments, the tubes 405 are made of clear PVC. The tubes may be made of plastics, polymers, metals or alloys. Further, the tubes may be coated with another material to increase performance and aesthetics or bring in desirable characteristics such as non-stickiness.

In some embodiments, the reservoir chambers may hold 1 to 300 gallons of water. In the exemplary embodiments shown in FIGS. 1, 2 and 4, each reservoir chamber 402 can hold 6 gallons of water or solvents and is made of plexiglass. The reservoir may be made of plastics, polymers, metals or alloys. Further, the reservoir may be coated with another material to increase performance and aesthetics or bring in desirable characteristics such as non-stickiness.

In some embodiments, the brush cleaner can hold and clean about 10-100 brushes, about 10-80 brushes, about 10-70 brushes, about 10-60 brushes, about 10-50 brushes, about 10-40 brushes, about 10-30 brushes or about 10-20 brushes in one cleaning cycle.

During a cleaning cycle, the brush cleaner may be programmed to deliver solvents from any of the two reservoir chambers 402 into the cleaning chamber 101. Each reservoir chamber 402 is fluidically connected to the cleaning chamber 101 through at least one pump 406 each. This allows filling of different solvents or solutions from the two reservoir chambers into the cleaning chamber 101 as needed. For example, one reservoir chamber may be filled with a detergent solution and the other may be filled with water. Brushes may be soaked and cleaned thoroughly with the detergent solution from the first reservoir chamber for a period of time, followed by draining of the detergent into the reservoir chamber from which it came. Following this, the remnants of detergent may be removed with water from the second reservoir chamber. In some embodiments, the brush cleaner may have a single cleaning chamber and a reservoir with no compartmentalization. In other embodiments, the brush cleaner may have a detachable partition that allows users to attach or remove the partition as and when desired to split or combine the compartments of the reservoir. When the reservoir chambers are combined into one and used, the brush cleaner may be programmed to use both pumps or one pump at a time or one pump all the time. In the embodiment shown in FIG. 6, there is one pump 406 in each reservoir chamber for pumping solvents into the cleaning chamber.

The housing 104 shown in FIGS. 1, 2 and 4A, easily fits on top of the reservoir 105. It is properly aligned with the help of guides that help to position and hold complementing parts on the housing and the reservoir. Further, a rubber gasket or the like that fits around the top perimeter of the reservoir 105 may be used to seal the space between the housing 104 and the reservoir 105 to prevent solvent leaks. The gasket could also seat the housing 104 properly on the reservoir 105. In the embodiment shown in FIGS. 1, 2 and 4A, the base or housing is made of plexiglass. The housing may be made of plastics, polymers, metals or alloys. Further, the housing may be coated with another material to increase performance and aesthetics or bring in desirable characteristics such as non-stickiness.

The cleaning chamber 101 and the reservoir chambers 402 are fluidically connected. The cleaning chamber 101 may have holes, channels or conduits that drain the liquids from the cleaning chamber down into the reservoir by gravity-flow. The dimensions, positioning and number of holes, channels or conduits can be increased or decreased to obtain different solvent drain rates from the cleaning chambers.

Figure 5:
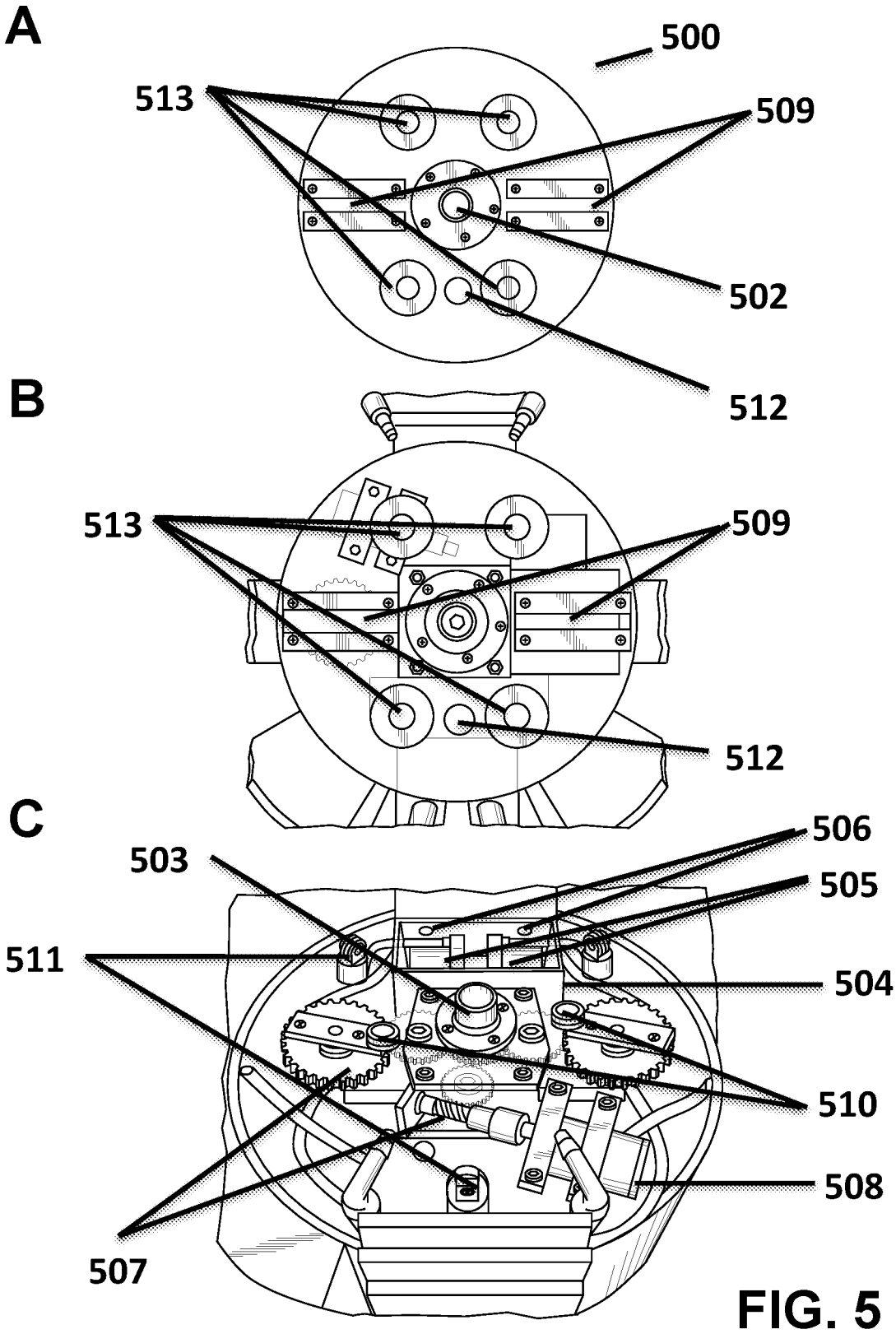
FIGS. 5A, 5B and 5C depict some components of the brush cleaner motor, drive and oscillating plate according to an embodiment.

In some embodiments, cleaning chamber sits on an oscillating plate 500. In some embodiments, the oscillating plate may be made integral with the chamber. Both the cleaning chamber 101 and oscillating plate 500 have draining holes for continuously draining the solvent from the chamber 101 into a common collection chamber 504 present inside the base or housing 104. FIGS. 5A and 5B shows draining hole 512 in the oscillating plate 500. As shown in FIG. 5B, two pumps 505 pump solvents collected in the chamber 504. Each pump drains the contents of the chamber 504 into only one of the reservoir chambers 402. The pump rate may be programmed, increased or decreased to obtain and match the solvent drain rates from the cleaning chambers into the chamber 504 such that a constant level of solvent is maintained in the cleaning chamber 101 during cleaning cycles. In addition, the same pumps 505 may be used to empty the contents of the cleaning chamber 101 into the reservoir chambers 402 after the end of a full cleaning cycle. The collection chamber 504 also has overflow outlets 506 that drain excess solvents accumulating in the collection chamber 504 into the reservoir chambers. In the embodiment shown in FIG. 5C, a single hole 313 in the cleaning plate 300 aligns with another hole of same diameter in the cleaning chamber 101 and a third hole in the oscillating plate 500, so that the solvent drains directly into the collection chamber 504. In addition the hole is also lined with gaskets and tubing that is configured to empty the draining contents into the bottom of the chamber 504 avoiding splashing and spilling. In some embodiments, the collection chamber is configured to function as a filtration system that removes dirt and debris in the solvent that is being drained from the cleaning chamber.

In some embodiments, the collection chamber 504 may be made fluid-tight except for the incoming drainage from the cleaning chamber 101, the outlet ports for the pumps 505 and the overflow outlets 506. This prevents liquids from leaking into the base or housing 104. In some embodiments, the overflow outlets may be regulated by valves that are electronically operated allowing controlled opening of one and not the other one of the two outlets, thereby preventing draining of solvent from one reservoir chamber into another reservoir chamber during recycling of the solvents.

Multiple ports 106 deliver liquids from the reservoir chambers 402 into the cleaning chamber 101. The number and placement of the ports 106 around the chamber 101 could be varied to obtain different flow rates or patterns. The pumps 406 regulate the flow rate of liquids pumped into the chamber 101. The presence of a partition between the reservoir chambers allows the use of different solutions in different chambers for step-wise cleaning of brushes in harsh detergents, mild detergents, specialized detergents, other cleaning solvents and water to obtain thorough cleaning. Cycling and recycling of the solvents between the reservoir and the cleaning chamber by the combined pumping action of the pumps 406 and 505 and draining through the holes, channels or conduits allows washing, cleaning and flushing of the brushes in a highly efficient manner, reducing the time required to clean brushes.

In some embodiments, the holes, channels or conduits originating at a location on the cleaning plate are aligned with those in the cleaning chamber 101 such that solvents can drain by gravity into the collection chamber 504 located beneath within the housing 104. In other embodiments, the channels or conduits are directly connected to the pumps 505 that actively drain out solvents from the chamber into the reservoir for cycling between the chamber and reservoir. In another embodiment, used solvents from the chamber do not drain into the reservoir. Instead it drains or is actively pumped into a separate drainage reservoir or a common sink like the ones found in bathrooms or kitchens. This could allow fresh solvent to fill in the chamber from the reservoir as the cleaning progresses and used solvent and debris to be removed continuously or at intervals, depending upon how the drain and/or pumps are programmed to operate.

In some embodiments, a filtration system in provided within the circulation system that delivers and drains the solvents between the chamber and the reservoir or its compartments. The filter comprises either supported or unsupported filters, meshes, porous membranes or filter cartridges filled with filtration material. They may be made of materials that aid in the removal of particulate, oily materials, hydrocarbons, and cell debris coming off from dirty brushes. Various polymers, foams, coal, diatomaceous earth, clay, carbon, sand, minerals, alloys, cotton, sponge, ceramics, and plant- or animal-derived fibers are non-limiting examples of filtration materials used in various embodiments. They increase the efficiency of cleaning by removing the debris that comes off in the solvent being drained from the chamber as the brushes are being cleaned, and preventing most of the debris from circulating back into the chamber when the solvent is circulated or recirculated during cleaning. They may accomplish increased efficiency by keeping the debris materials' concentration gradient between the brushes and cleaning solvents as steep as possible. The collection chamber 504 may be configured to function as a filtration system.

In some embodiments, the undersurface of the cleaning chamber 101 attached to an oscillating plate 500 connects the cleaning chamber to the drive 507 driven by a motor 508 (FIG. 5C). In some embodiments, the oscillating plate is circular as shown in FIG. 5A and contains a hole 502 at the centre that accepts a receptor 503 for a bearing present on the lower side of the cleaning chamber 101. The oscillating plate also harbors tracks 509 for the rollers 510 from the drive 507 shown in FIG. 5C. The rollers are held on shafts connecting them to the drive. As shown in FIG. 5C, the drive 507 comprises many gears that convert rotatory motions of the motor 508 into repetitive reciprocating motors of the cleaning chamber 101 through the oscillating plate 500. The oscillating plate 500 rests on rollers 511 that reduce friction during its back and forth motions above the housing 104. Guides 513 present on the oscillating plate 500 allow stable positioning of the cleaning chamber 101 on the plate and also align the drainage into the collection chamber 504. Snug-fit guides on the oscillating plates allow easy placement and easy removal of the chamber for cleaning or for replacement.

In some embodiments, the cleaning chamber may be positioned directly on the housing without an intermediary oscillating plate. In these embodiments, the receptor for the bearing on the cleaning chamber is presented on a longitudinal support located around the center of the housing. Additional supports that stabilize the chamber in a horizontal position and at the same time allow reciprocating motions of the chamber may be provided on similar supports arranged around the periphery of the housing.

The housing, intermediate plate and components of the drive may be made from any plastic, metals or alloy materials as described in the disclosure that can be used for high-load mechanical applications.

The cleaning chamber, intermediate plate, housing, and reservoir may be configured to match in their shapes. The motor that drives the cleaning chamber may be chosen depending upon the power required to support the motions of dozens of brushes during cleaning cycles.

In an exemplary embodiment, silicone lubricants are used on the moving parts of the drive and the rollers to reduce friction. Substitutions known in the art maybe used in its place such as natural, petroleum-based or synthetic lubricants. They may increase their functionality and life of the drive and the cleaner.

The addition of adjustable or fixed capacity resistors, capacitors, potentiometers, circuitry, programmable printed circuit boards, wiring and the like known in the art between the power source and the motors and the pumps will allow efficient operation of the brush cleaner. Further, additional circuit controls, circuitry, switches and wires may be provided as necessary and by methods known in the art to allow independent control and operation of the cleaning chambers, lid, solvent recirculation and draining. The operations may also be made semi- or fully automatic.

Other controls and user interfaces such as, graphic video display, LCD screen, timers, audio signals, icons, LED indicators may be associated with the control panel and used for interfacing with the cleaner. Further, the user interface can include any type of controller having an algorithm, hardware or software for programming the brush cleaner. The hardware/software program can be configured to control the length and frequency of the cleaning cycle, the speed of the cleaning chamber and the speed of the brush holder.

Also disclosed herein are methods to clean the brushes. In one embodiment, a cleaning cycle is initiated by attaching one or more used makeup brushes to the securement members 110 on the lid such that the bristle end of the brushes face towards the cleaning chamber 101. A positioning plate is used to adjust optimal placement of the brushes. The brush cleaner is turned on and programmed for a soak-wash-rinse cycle. The lid is closed by pressing it against the cleaning chamber until it is locked in place. Upon closing the lid, soap solution from one reservoir chamber is pumped into the cleaning chamber 101 until it immersed the bristles of the brushes. The bristles of the brushes remained immersed in the soap solution during the soaking segment of the cycle that lasts for 15 minutes. Upon completion of soaking, the washing segment that lasts 15 minutes is automatically initiated. During this segment, the cleaning chamber starts reciprocating motions and the soap solution is recycled between the cleaning chamber and the soap reservoir chamber. Rapid circular reciprocating motions cause the bristles to rub against the cleaning elements 206 present within the cleaning chamber 101 in the presence of a cleaning solvent. The vibratory motions further enhance cleaning. It removes the dirt, debris and other material sticking to the brushes. The filtration system removes the dirt and debris in the solvent as they are drained into the reservoir.

At the end of the washing segment, the cleaning chamber stops motions and the soap solution is drained completely into the chamber containing the soap solution. Subsequently, the rinse cycle of the program is initiated during which water is pumped from the reservoir chamber containing water into the cleaning chamber. Once the bristles are immersed in water, the cleaning chamber reciprocates for 15 minutes. Rapid circular reciprocating motions cause the bristles to rub against the cleaning elements 206 present within the cleaning chamber 101 in the presence of water. Vibratory motions further enhance the cleaning of the brushes at this stage. At the end of the rinse segment, the chamber stops motions and the water is drained into the reservoir chamber containing water. Once the water is drained, the lid opens automatically through the release of the electromagnetic lock. The lid stays open at a 45 degree angle allowing the solvent sticking to the brushes to drip and drain into the cleaning chamber. The open lid allows brushes to air dry. The brushes are left in the securement members of the open lid until they are dried. A fan integral with the cleaner accelerates the drying process.

The circular reciprocating motions may be at a frequency of 10 to 1000 per second. The reciprocating motions may be range of 5 mm to 30 mm. Due to the motions of the cleaning chamber (back and forth circular reciprocating motion and the vibratory motions), the continuous recycling of the cleaning solvent between the reservoir chambers and the cleaning chamber and the rinse cycle after the wash cycle, the brushes are cleaned rapidly, efficiently and automatically. Each cleaning cycle can include a soak segment using detergents pumped from one reservoir chamber, a wash segment again using detergents supplied from the same reservoir chamber, and a rinse segment using water pumped from the second reservoir chamber. The soaking segment may last from 5 minutes to 5 hours, the wash segments may be from about 30 seconds to about 120 minutes, and the rinse segments may last from about 30 seconds to about 120 minutes. In some embodiments, the wash segment and the rinse segment can be performed multiple times until the desired cleaning is achieved. In some embodiments, a wash segment may be followed by multiple rinse segments.

In some embodiments, areas of the brush cleaner, such as the bottom surface of the reservoir and/or the bottom of the housing, that contact a resting surface during the operation or storage of the brush cleaner may have anti-skid or non-slip devices such as suction cups or anti-slip pads or tapes or the like. They will hold the brush cleaner stably in position during its operation or storage preventing it from moving around. In some embodiments, the reservoir may be attached to a mobile support that may allow moving the cleaner around. One non-limiting example would be wheels that are provided at the bottom of the reservoir. Additionally, the wheels may also have locks that will allow locking them in place, once the cleaner has been moved into a convenient location. In some embodiments, the brush cleaner may be integrated into a luggage system so that it can be easily transported from place to place during travel. Moreover, the cleaner may be also configured to operate without taking it out of the luggage system.

Since the solvents circulate between the cleaning chamber and the reservoir chamber from which it is drawn, continuously during the operation of the brush cleaner, the turbidity of the solvent may gradually increase when the dirt from the brushes' bristles are dislodged. In some embodiments, the reservoir may have a sensor to detect the turbidity of the solvent, and may indicate the cleaning progress. For example, a constant rate of increase in the turbidity may indicate that the brushes are still dirty, however, if the turbidity remains constant over time it may indicate that the brushes are clear of dirt and the cleaning process is complete.

Also disclosed herein are kits for cleaning brushes. The kits may contain disposable cleaning chambers, disposable cleaning plates as described herein. Further, the kit may further contain step-by-step instructions to remove and replace the cleaning chamber and cleaning plate of the brush cleaner. The kit may further contain means of attachment such as adhesives, screws, clamps, pins, nuts, threads, rivets and the like that may be necessary. Further, the kit may contain filtration system and/or circulation system components, which may be custom-made. They may contain any other part that is subject to wear and tear during use and needs replacement on a regular basis. This is especially important for large scale or commercial applications of the large capacity brush cleaner.

The brush cleaner device described herein may increase the efficiency of brush cleaning by using reciprocating motions combined with the vibratory motions that clean the brushes rapidly, albeit gently. This may be contrasted with the harsh mechanical scrubbing of the brushes against a cleaning surface, which is currently prevalent in the art. This can take hours to completely clean dozens of brushes after a tiring day. Also contrast the brush cleaner disclosed in the application to overnight soaking of dozens of brushes in soap solution followed by hand washing. The latter causes, the glue holding the bristles to the handle of the brush to give way and the bristles come off from the handle as a result. The option to use detachable cleaning chambers and detachable cleaning plates provides the user with the ability to clean the parts of the apparatus that get dirty without lifting the entire cleaner. In addition, making the chambers and plate and elements with dishwasher safe materials will allow then to be washed automatically when desired.

The brush cleaner disclosed herein may be used to clean any brushes, such as makeup brushes, paintbrushes, toothbrushes and the like. The embodiments disclosed herein may find applications especially in personal care industry, such as beauty salons, spas, hotels, and the like.

While preferred embodiments have been shown and described, various modifications and substitutions may be made thereto without departing from the spirit and scope of the method and device. Accordingly, it is to be understood that the present method and device has been described by way of illustration and not limitation.

This disclosure is not limited to the particular systems, devices and methods described, as these may vary. The terminology used in the description is for the purpose of describing the particular versions or embodiments only, and is not intended to limit the scope.

In the above detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be used, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds, compositions or biological systems, which can, of course, vary. It is also to be understood that the terminology used herein is for the purpose of describing particular embodiments only, and is not intended to be limiting.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

Various of the above-disclosed and other features and functions, or alternatives thereof, may be combined into many other different systems or applications. Various presently unforeseen or unanticipated alternatives, modifications, variations or improvements therein may be subsequently made by those skilled in the art, each of which is also intended to be encompassed by the disclosed embodiments.

What is claimed is:

1. A brush cleaner comprising:

a base;

a cleaning chamber comprising a plurality of cleaning elements disposed on a cleaning plate;

the cleaning plate comprising a flat element that can snugly fit into the cleaning chamber;

the cleaning chamber comprising one or more flat- or paddle-shaped elements configured to increase mixing of the solvents within the chamber;

a vibratory motor attached to the base or the cleaning chamber and configured to vibrate the cleaning plate or the cleaning chamber or both;

a lid attached to the cleaning chamber, wherein the lid comprises a plurality of securement members configured to hold brushes;

a solvent circulation system comprising a reservoir and one or more compartments that is fluidically in contact with the cleaning chamber and is configured to deliver solvents from the compartments into the cleaning chamber, and drain solvents from the cleaning chamber into the compartments;

a filtering system comprising filters or filter cartridges within the solvent circulating system configured to remove dirt and debris present in the solvents drained into the compartments;

a motor mounted on the base and attached to the undersurface of the cleaning chamber via a drive, wherein the motor and the drive are configured to provide repetitive motions to the cleaning chamber; and a user interface for programming operations of the brush cleaner.

2. The brush cleaner of claim 1, wherein the cleaning chamber is detachable from the drive.

3. The brush cleaner of claim 1, where in the opening of the lid is dampened.

4. The brush cleaner of claim 1, wherein the opening and closing of the lid can be programmed to mark the beginning and end of cleaning cycles.

5. The brush cleaner of claim 1, wherein the lid is configured to automatically hold brushes in a position that drains solvents sticking to the brushes at the end of a cleaning cycle into the cleaning chamber and subsequently air drying the brushes.

6. The brush cleaner of claim 1, where the solvent circulation system is configured to mix solvents in the reservoir before a cleaning cycle begins.

7. The brush cleaner of claim 1, wherein the solvent circulation system is configured to deliver mixed solvents into the cleaning chamber before a cleaning cycle begins and recycle them at different times and at different rates during a cleaning cycle.

8. The brush cleaner of claim 1, wherein the solvent circulation system is programmed to drain solvents from the cleaning chamber at the end of a cleaning cycle.

9. The brush cleaner of claim 1, wherein the securement members hold brushes in place with elastic bands made of a thermoplastic elastomer material capable of stretching 1.5 to 5 times.

10. The brush cleaner of claim 9, wherein the elastic bands are detachable and replaceable.

11. The brush cleaner of claim 9, wherein the elastic bands have more than one fused criss-cross.

12. The brush cleaner of claim 1, wherein the cleaning chamber has a height of about 5 inch to about 16 inches, and a diameter of about 12 inch to about 24 inches.

13. The brush cleaner of claim 1, wherein the cleaning chamber is configured to undergo 30-120 repetitive motions per minute.

14. The brush cleaner of claim 1, wherein the cleaning elements are about 0.1 inches to 3 inches in length, and about 0.1 inches to 3 inches in thickness.

15. The brush cleaner of claim 1, wherein the solvent circulation system further comprises at least one solvent dispensing port adjacent to the cleaning chamber.

16. The brush cleaner of claim 1, wherein the solvent circulation system is configured to circulate 20-200 ml of solvent per minute.

17. The brush cleaner of claim 1, wherein the lid is configured to undergo vibratory motions that are programmable.

18. The brush cleaner of claim 1, further comprising leveling screws and spirit level to keep the cleaner at level on a surface.

19. The brush cleaner of claim 1 configured to attach the reservoir to a source of water.

* * * * *